US011408678B2

(12) United States Patent
Yamamori et al.

(10) Patent No.: US 11,408,678 B2
(45) Date of Patent: Aug. 9, 2022

(54) METHOD AND APPARATUS FOR SEPARATING HYDROCARBONS

(71) Applicant: TOYO ENGINEERING CORPORATION, Tokyo (JP)

(72) Inventors: Yasuyuki Yamamori, Narashino (JP); Xiaoxue Zhang, Narashino (JP)

(73) Assignee: TOYO ENGINEERING CORPORATION, Tokyo (JP)

( * ) Notice: Subject to any disclaimer, the term of this patent is extended or adjusted under 35 U.S.C. 154(b) by 281 days.

(21) Appl. No.: 16/168,646

(22) Filed: Oct. 23, 2018

(65) Prior Publication Data

US 2019/0128600 A1 May 2, 2019

(30) Foreign Application Priority Data

Nov. 1, 2017 (JP) ..... JP2017-211791

(51) Int. Cl.

*F25J 3/02* (2006.01)
*F25J 1/00* (2006.01)
*F25J 3/06* (2006.01)

(52) U.S. Cl.

CPC ..... *F25J 3/0214* (2013.01); *F25J 1/0022* (2013.01); *F25J 1/0052* (2013.01); *F25J 3/0233* (2013.01); *F25J 3/0242* (2013.01); *F25J 3/064* (2013.01); *F25J 2200/02* (2013.01); *F25J 2200/04* (2013.01); *F25J 2200/50* (2013.01); *F25J 2200/70* (2013.01); *F25J 2200/72* (2013.01); *F25J 2200/78* (2013.01); *F25J 2205/04* (2013.01); *F25J 2210/06* (2013.01); *F25J 2220/64* (2013.01); *F25J 2230/60* (2013.01); *F25J 2235/60* (2013.01)

(58) Field of Classification Search

CPC ..... F25J 3/0242; F25J 3/0233; F25J 3/0238; F25J 2200/02; F25J 3/0247; F25J 3/0257; F25J 3/0615; F25J 3/064; F25J 3/0645; F25J 3/065; F25J 3/066; F25J 3/0214; F25J 3/0209; F25J 2200/04; F25J 2220/64; F25J 2230/60; F25J 1/0022; F25J 1/0052

See application file for complete search history.

(56) References Cited

U.S. PATENT DOCUMENTS 2,952,984 A 9/1960 Marshall, Jr.
3,834,122 A 9/1974 Allison et al.
(Continued)

FOREIGN PATENT DOCUMENTS

CN 1737087 A 2/2006
CN 101027528 A * 8/2007 ..... F25J 3/0238
(Continued)

OTHER PUBLICATIONS

Distillation Columns—Internal Reflux Control—Jim Ford (Aug. 2012) (Year: 2012).*
(Continued)

*Primary Examiner* — Jenna M Hopkins
(74) *Attorney, Agent, or Firm* — Foley & Lardner LLP

(57) ABSTRACT

The claimed invention provides a method and an apparatus for separating hydrocarbons, wherein the method and the apparatus are used for separating a hydrocarbon having 3 or more carbon atoms including at least propane (hereinafter sometimes called "C3+ NGL". NGL: Natural Gas Liquid) from liquefied natural gas (LNG).

9 Claims, 8 Drawing Sheets

(56) References Cited

U.S. PATENT DOCUMENTS

| | | | | |
|---|---|---|---|---|
| 6,251,290 | B1 | 6/2001 | Conaway | |
| 6,367,286 | B1 | 4/2002 | Price | |
| 6,510,706 | B2 | 1/2003 | Stone et al. | |
| 7,216,507 | B2 * | 5/2007 | Cuellar | F25J 3/0214 62/620 |
| 7,310,972 | B2 * | 12/2007 | Yoshida | B01D 3/14 62/618 |
| 7,475,566 | B2 * | 1/2009 | Schroeder | F25J 3/0214 62/614 |
| 8,794,029 | B2 * | 8/2014 | Yokohata | F25J 3/0233 62/620 |
| 2008/0016910 | A1 | 1/2008 | Brostow et al. | |
| 2008/0087041 | A1 * | 4/2008 | Denton | F25J 3/0238 62/618 |
| 2008/0264100 | A1 * | 10/2008 | Mak | F25J 3/0242 62/618 |
| 2009/0221864 | A1 * | 9/2009 | Mak | F25J 3/0214 585/803 |
| 2010/0011809 | A1 | 1/2010 | Mak | |
| 2011/0265511 | A1 * | 11/2011 | Fischer | F25J 1/0292 62/611 |
| 2012/0000245 | A1 * | 1/2012 | Currence | F25J 3/0242 62/620 |
| 2013/0061632 | A1 | 3/2013 | Brostow et al. | |
| 2015/0267137 | A1 * | 9/2015 | Sapper | F25J 3/0247 62/620 |
| 2015/0276307 | A1 * | 10/2015 | Ohart | F25J 1/0242 62/613 |
| 2017/0122658 | A1 * | 5/2017 | Currence | F25J 1/0022 |
| 2017/0176099 | A1 * | 6/2017 | Gaskin | F25J 3/0242 |

FOREIGN PATENT DOCUMENTS

| | | | | |
|---|---|---|---|---|
| CN | 101027528 | A | 8/2007 | |
| CN | 101108977 | A | 1/2008 | |
| CN | 102767936 | A | 11/2012 | |
| CN | 104140349 | A | 11/2014 | |
| JP | 2009-538372 | A | 11/2009 | |
| WO | WO 2002/102717 | A1 | 12/2002 | |
| WO | WO-03085340 | A2 * | 10/2003 | F25J 3/0214 |
| WO | WO 2006/031362 | A1 | 3/2006 | |

OTHER PUBLICATIONS

Office Action issued in co-pending Chinese Patent Application No. 201811254538.X, dated Jul. 30, 2021.

Notice of Reasons for Refusal issued in Japanese Patent Application No. 2017-211791, dated Sep. 7, 2021.

Examination Report issued in co-pending India Patent Application No. 201844039308, dated Oct. 27, 2021.

* cited by examiner

METHOD AND APPARATUS FOR SEPARATING HYDROCARBONS

This application is based upon and claims the benefit of priority from Japanese patent application No. 2017-211791, filed on Nov. 1, 2017, the disclosure of which is incorporated herein in its entirety by reference.

BACKGROUND OF THE INVENTION

Field of the Invention

The present invention relates to a method and an apparatus for separating hydrocarbons, wherein the method and the apparatus are used for separating a hydrocarbon having 3 or more carbon atoms including at least propane (hereinafter sometimes called "C3+ NGL". NGL: Natural Gas Liquid) from liquefied natural gas (LNG).

Description of the Related Art

LNG is received and stored in LNG tanks in LNG receiving terminals of consuming countries after liquefaction and export by producing countries. In order to utilize LNG as fuel gas in end users, LNG is pressurized by a pump and then vaporized and sent out to a natural gas pipeline. Methane is a major portion among hydrocarbon components in LNG. LNG also contains ethane and heavier hydrocarbons having 3 or more carbon atoms including propane.

When LNG contains a large amount of heavier hydrocarbons, the heating value of the LNG becomes high, and therefore the LNG may not meet the pipeline natural gas specification required for users in each region. On the other hand, since heavier hydrocarbons can be used as raw materials in petrochemical plants, they may have a higher market value than in the case when they are utilized as city gas or the fuel of thermal power plants. Accordingly, it may be desirable to separate and recover heavier hydrocarbons from feed LNG received in the LNG receiving terminals before the feed LNG is sent to natural gas pipelines. Therefore, feed LNG is separated to obtain C3+ NGL, and LNG enriched in methane and ethane (this LNG may be hereinafter called "product LNG").

A distillation column is used in a method for separating C3+ NGL from feed LNG. Product LNG is obtained from the overhead of the distillation column. To send the overhead vapor of this distillation column to natural gas pipelines, the overhead vapor is pressurized to a pipeline pressure and then returned to an LNG terminal. When the overhead vapor of this distillation column is sent back to LNG receiving terminal, the energy required for the pressurization is lower in the case of liquefying the vapor and then pressurizing the resulting liquid with a pump than in the case of compressing the vapor in a gaseous phase.

Processes for separating hydrocarbons from feed LNG, wherein the processes can totally condense the overhead vapor of a distillation column without using a compressor, are disclosed in U.S. Pat. Nos. 6,510,706, 2,952,984, and 7,216,507.

In a method for separating hydrocarbons from feed LNG disclosed in U.S. Pat. No. 6,510,706, a part of feed LNG is used as reflux liquid of a distillation column. Therefore, a sufficient reflux effect cannot be obtained, and the propane recovery rate is relatively low.

In U.S. Pat. No. 2,952,984, since condensed overhead vapor of the distillation column is used as reflux liquid, the reflux effect is high and a high propane recovery rate can be obtained. However, since only one distillation column is used, the vapor load in the distillation column is relatively high. Therefore, the diameter of the distillation column becomes large.

In U.S. Pat. No. 7,216,507, two columns are used in a distillation apparatus. Therefore, the vapor load in the first column can be reduced than in the case where only one column is used in a distillation apparatus. Herein, as a process for separating hydrocarbons from feed LNG using two distillation columns, a distillation column which is located upstream in relation to the feed LNG stream may be called a "first distillation column" or a "first column", and a distillation column which is located downstream in relation to the feed LNG stream may be called a "second distillation column" or a "second column".

However, the overhead vapor of the first column is totally condensed by increasing the operating pressure of the first column in U.S. Pat. No. 7,216,507. The first column is a unit having the largest volume in the separation apparatus because it treats methane contained as the major component in the feed LNG. Therefore, it is preferable to reduce the operating pressure of the first column. When the operating pressure is low, the separation efficiency is improved and the load in the column is reduced. Also, the required wall thickness of a pressure vessel constituting the distillation column can be reduced.

Accordingly, an improved method for separating hydrocarbons wherein feed LNG is separated into product LNG (a liquid fraction enriched in methane and ethane) and a liquid fraction enriched in C3+ NGL (a hydrocarbon having 3 or more carbon atoms including at least propane) has been desired.

An object of the present invention is to provide a method for separating hydrocarbons wherein feed LNG is separated into product LNG and a liquid fraction enriched in C3+ NGL, and wherein the following i to iv can be achieved at the same time. Another object of the present invention is to provide an apparatus for separating hydrocarbons wherein feed LNG is separated into product LNG and a liquid fraction enriched in C3+ NGL, and wherein the following i to iv can be achieved at the same time.

i) Being able to prevent an increase in the vapor load in a first column by using two distillation columns.

ii) Being able to totally condense the overhead vapor of the first column without needing a compressor.

iii) Being able to achieve a high recovery rate of propane using a small amount of utility (externally supplied heat).

iv) Being able to make the operating pressure of the first column relatively low.

SUMMARY OF THE INVENTION

An aspect of the present invention provides a method for separating hydrocarbons wherein feed liquefied natural gas containing methane, ethane, and a hydrocarbon having 3 or more carbon atoms including at least propane is separated into a liquid fraction enriched in methane and ethane and a liquid fraction enriched in the hydrocarbon having 3 or more carbon atoms, including:

(a) heating the feed liquefied natural gas in a heat exchanger to partially vaporize the feed liquefied natural gas to obtain a vapor-liquid two-phase stream;

(b) supplying the whole or a liquid phase of the vapor-liquid two-phase stream to a first distillation column, and separating the supplied whole or liquid phase of the vapor-liquid two-phase stream into first overhead vapor enriched in methane and first bottom liquid enriched in ethane and the hydrocarbon having 3 or more carbon atoms by the first distillation column;

(c) separating the first bottom liquid into second overhead vapor enriched in ethane and second bottom liquid enriched in the hydrocarbon having 3 or more carbon atoms by a second distillation column;

(d) cooling the second overhead vapor to condense the whole or a part of the second overhead vapor to obtain condensed liquid;

(e) dividing the condensed liquid into two or more streams, and obtaining a mixed stream of one of the divided streams and the first overhead vapor;

(f) totally condensing the mixed stream obtained from step (e) by exchanging heat with the feed liquefied natural gas in the heat exchanger, to obtain a liquid stream;

(g) discharging the whole or a part of the liquid stream obtained from step (0, as the liquid fraction enriched in methane and ethane;

(h) supplying another of the two or more streams obtained by dividing the condensed liquid in step (e) to the second distillation column as reflux liquid; and (i) discharging the second bottom liquid as the liquid fraction enriched in the hydrocarbon having 3 or more carbon atoms.

Another aspect of the present invention provides an apparatus for separating hydrocarbons wherein feed liquefied natural gas containing methane, ethane, and a hydrocarbon having 3 or more carbon atoms including at least propane is separated into a liquid fraction enriched in methane and ethane and a liquid fraction enriched in the hydrocarbon having 3 or more carbon atoms, including:

a heat exchanger configured to heat the feed liquefied natural gas to partially vaporize the feed liquefied natural gas to obtain a vapor-liquid two-phase stream;

a first distillation column to which the whole or a liquid phase of the vapor-liquid two-phase stream is supplied and which is configured to separate the supplied whole or liquid phase of the vapor-liquid two-phase stream into first overhead vapor enriched in methane and first bottom liquid enriched in ethane and the hydrocarbon having 3 or more carbon atoms;

a second distillation column configured to separate the first bottom liquid into second overhead vapor enriched in ethane and second bottom liquid enriched in the hydrocarbon having 3 or more carbon atoms;

a condenser configured to cool the second overhead vapor to condense the whole or a part of the second overhead vapor to obtain condensed liquid; and lines for dividing the condensed liquid into two or more streams, and for obtaining a mixed stream of one of the divided streams and the first overhead vapor, wherein the heat exchanger is configured to totally condense the mixed stream by exchanging heat with the feed liquefied natural gas to obtain a liquid stream, and wherein the apparatus further includes:

a first discharge line for discharging the whole or a part of the liquid stream obtained from the heat exchanger as the liquid fraction enriched in methane and ethane;

a reflux line for supplying another of the two or more streams obtained by dividing the condensed liquid to the second distillation column as reflux liquid; and a second discharge line for discharging the second bottom liquid as the liquid fraction enriched in the hydrocarbon having 3 or more carbon atoms.

An aspect of the present invention provides a method for separating hydrocarbons wherein feed LNG is separated into product LNG and a liquid fraction enriched in C3+ NGL, and wherein the above-mentioned i to iv can be achieved at the same time. Another aspect of the present invention provides an apparatus for separating hydrocarbons wherein feed LNG is separated into product LNG and a liquid fraction enriched in C3+ NGL, and wherein the above-mentioned i to iv can be achieved at the same time.

DETAILED DESCRIPTION OF THE PREFERRED EMBODIMENTS

According to the present invention, two distillation columns are used. The condensing temperature of the overhead vapor of the first column is raised by mixing a part of condensed liquid of the overhead vapor of the second column with the overhead vapor of the first column. Thereby, the overhead vapor of the first column can be totally condensed at a low operating pressure of the first column without being pressurized by a compressor. Since the separation efficiency is improved by keeping the operating pressure of the first column low, the amount of the reflux liquid of the first column can be reduced, and the vapor and liquid loads of the first column can be suppressed at relatively low levels. Since the heat duty (reboiler duty) applied to the distillation column (the first column) also decreases, the energy consumption can also be lower than that of the conventional technologies. Additionally, the high propane recovery rate can be obtained by using another part of the condensed liquid of the overhead vapor of the second column as the reflux liquid of the second column.

Figure 4:
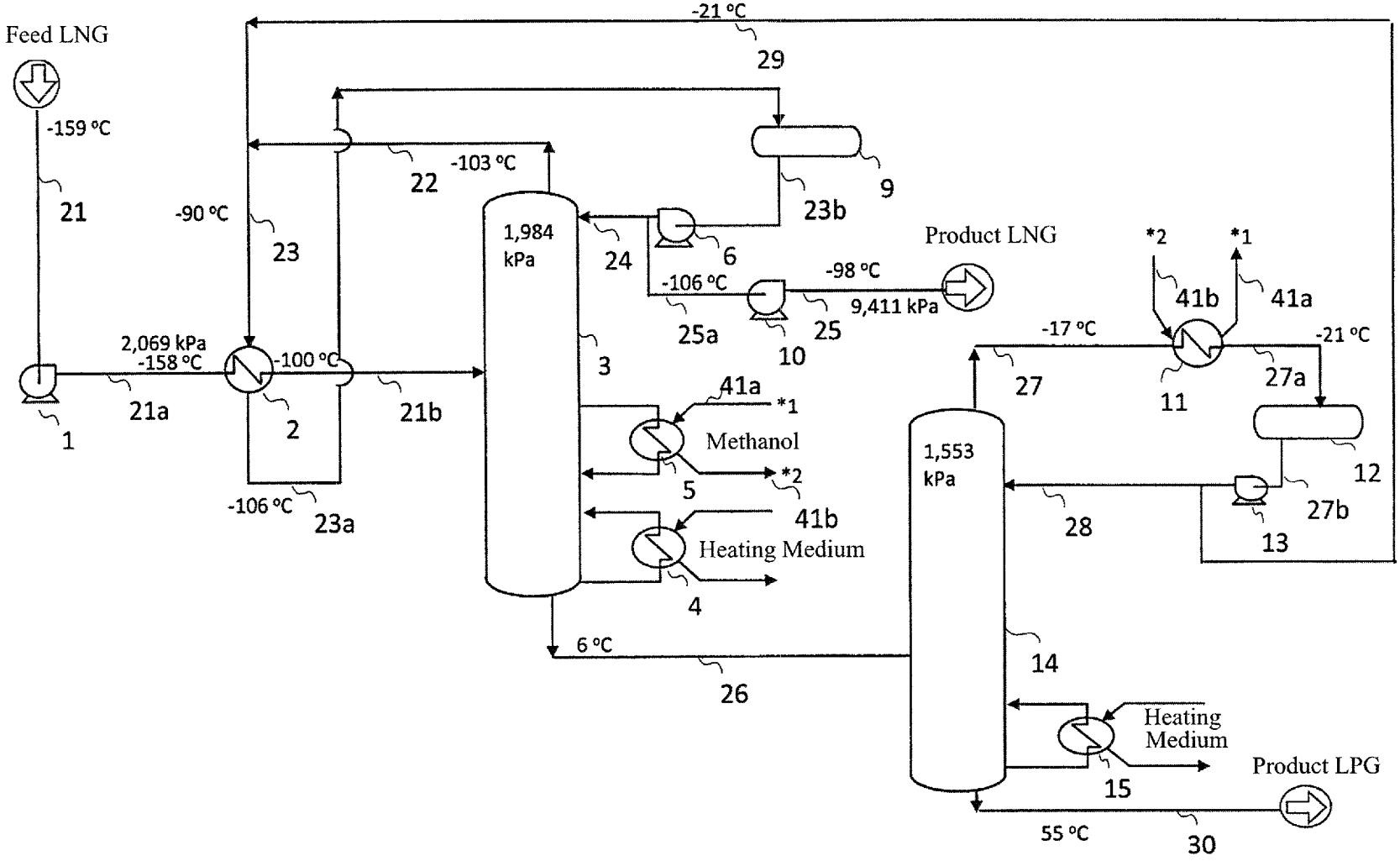
FIG. 4 is a process flow diagram illustrating an embodiment of a method for separating hydrocarbons of the present invention.

Although the present invention will be described hereinafter with reference to the drawings, the present invention is not limited thereto. First, FIG. 4 is referred to.

The present invention relates to a method and apparatus for separating hydrocarbons wherein feed liquefied natural gas (feed LNG) 21 containing methane, ethane, and a hydrocarbon having 3 or more carbon atoms including at least propane is separated. According to the present invention, a liquid fraction enriched in methane and ethane is obtained as product LNG 25, and a liquid fraction enriched in a hydrocarbon having 3 or more carbon atoms including at least propane can be obtained as bottom product (this may be hereinafter called "product LPG") 30. The method of the present invention includes the following steps (a) to (i).

(a) A step of heating feed LNG 21 in heat exchanger 2 to partially vaporize feed LNG 21 to obtain a vapor-liquid two-phase stream (stream 21*b*).

Before step (a), feed LNG 21 is pressurized by pump 1 to a pressure at which LNG 21 can be supplied to first column 3 if necessary (stream 21*a*). In heat exchanger 2, the cold heat of pressurized feed LNG 21*a* can be recovered, and first overhead vapor (stream 23 mentioned below in detail) can be condensed. The feed LNG is partially vaporized and becomes vapor-liquid two-phase stream 21*b*.

(b) A step of supplying the whole or a liquid phase of vapor-liquid two-phase stream 21*b* to first distillation column 3 and separating the supplied fluid (the whole or the liquid phase of vapor-liquid two-phase stream 21*b*) into first overhead vapor 22 enriched in methane and first bottom liquid 26 enriched in ethane and C3+ NGL by first distillation column 3.

In FIG. 4, the whole of vapor-liquid two-phase stream 21*b* are supplied to first column 3. For this purpose, the outlet of vapor-liquid two-phase stream 21*b* of the heat exchanger is connected to the inlet of first column 3. Alternatively, the liquid phase of vapor-liquid two-phase stream 21*b* can be supplied to first distillation column 3. In this case, only the liquid phase (stream 32 in FIG. 7) obtained by performing vapor-liquid separation of vapor-liquid two-phase stream 21*b* in a vapor-liquid separator (separator 16 in FIG. 7) is supplied to first column 3. In this case, the vapor phase (stream 31 in FIG. 7) obtained from the vapor-liquid separation can be mixed into first overhead vapor 22 (step (k)).

In first column 3, methane and hydrocarbons having 2 or more carbon atoms (it may be hereinafter called "C2+ NGL".) are separated. In first column 3, mainly methane (first overhead vapor 22) is obtained from the overhead, and mainly C2+ NGL (first bottom liquid 26) is obtained from the bottom. First bottom liquid 26 is supplied to second column 14.

(c) A step of separating first bottom liquid 26 into second overhead vapor 27 enriched in ethane and second bottom liquid 30 enriched in a hydrocarbon having 3 or more carbon atoms (C3+ NGL) including at least propane, by second distillation column 14.

In other words, ethane and "C3+ NGL" are separated in second column 14.

(d) A step of cooling second overhead vapor 27 to condense the whole or a part of second overhead vapor 27 to obtain condensed liquid 27*b*.

Second overhead vapor 27 can be cooled in condenser (heat exchanger) 11. Cooled second overhead vapor 27*a* is supplied to drum (second column reflux drum) 12 if necessary, and condensed liquid 27*b* is obtained from drum 12. In the process shown in FIG. 4, second overhead vapor 27 is totally condensed in step (d), and stream 27*a* and stream 27*b* are the same in this case. In step (d), when only a part of second overhead vapor 27 is condensed, a vapor phase (not shown) contained in stream 27*a* can be withdrawn from drum 12, and a liquid phase can be obtained as condensed liquid 27*b* of the second overhead vapor. The vapor phase of stream 27*a* can be used as product ethane.

As shown in FIG. 4, it is preferable to condense second overhead vapor 27, namely the overhead vapor of the second column (main component: ethane), by cooling this vapor by using cold heat which the fluid inside first column 3 has. However, this is non-limiting, and this cooling can also be performed using another proper fluid.

In particular, anti-freezing liquid such as methanol may be used as a heating medium (specifically, intermediate heating medium), the heating medium may be cooled in a heating medium cooler using cold heat which the fluid inside the first column has. The second overhead vapor can be cooled using this cooled heating medium in step (d).

Specifically, the fluid inside first column 3 is withdrawn, and is used to cool intermediate heating medium 41*a* in side reboiler 5 (heat exchanger) that is a heating medium cooler, and the withdrawn fluid is returned to first column 3. Cooled intermediate heating medium 41*b* is supplied to overhead condenser 11 of the second column to cool second overhead vapor 27 by heat exchange. This intermediate heating medium 41*a* after this cooling is circulated to side reboiler 5. For this purpose, the following lines can be used: a line for withdrawing fluid inside first column 3, and returning the withdrawn fluid to first column 3 via side reboiler 5; and a circulation line in which an intermediate heating medium flows through side reboiler 5 and overhead condenser 11 of the second column (line forming a closed loop).

Alternatively, the cooling in step (d) can be performed by giving cold heat which the fluid inside first column 3 has directly to second overhead vapor 27 by heat exchange (namely, without using an intermediate heat medium). For this purpose, for example, the process shown in FIG. 4 can be modified as follows: the fluid inside first column 3 is withdrawn and supplied to condenser 11, second overhead vapor 27 is cooled by exchanging heat between this fluid and second overhead vapor 27, and the fluid which has been used for this cooling is returned to first column 3. In this case, side reboiler 5 as a heating medium cooler is not used. Overhead condenser 11 of the second column functions as a side reboiler of the first column.

Alternatively, the cooling in step (d) may be performed using an external refrigerant instead of using cold heat which the fluid inside first column 3 has. The external refrigerant is a refrigerant which is supplied to the process according to the present invention as utility. As the external refrigerant, for example, one selected from the group consisting of ethane, ethylene, propane and propylene, or a mixture of two or more thereof can be used. In this case, the external refrigerant can be supplied to condenser 11 from the outside of the process, the cooling in step (d) can be performed by exchanging heat between the external refrigerant and second overhead vapor 27 in the condenser, and the external refrigerant after the cooling can be returned out of the process.

(e) a step of dividing condensed liquid 27*b* of the second overhead vapor into two or more streams, and obtaining mixed stream 23 of one (stream 29) of the divided streams and first overhead vapor 22.

Mixing a part of condensed liquid 27*b* mainly including liquid ethane into the first overhead vapor contributes to raising the condensing temperature of the first overhead vapor.

Another (stream other than stream 29) of the two or more streams obtained by dividing condensed liquid 27*b* is supplied to second column 14 as reflux liquid 28 (step (h)). For example, condensed liquid 27*b* may be divided into two streams, and one of the two streams may be used as stream 29 which is mixed with first overhead vapor 22. In this case, the other of the two streams is supplied to the second column as reflux liquid 28. Alternatively, condensed liquid 27*b* may be divided into three streams, one of the three streams may be used as stream 29, another may be used as reflux liquid 28, and the other may be withdrawn out of the system as product ethane. In the process shown in FIG. 4, condensed liquid 27*b* is pressurized by pump (second column reflux pump) 13, and the pressurized condensed liquid is divided into two streams. One of the two streams is used as stream 29, and the other is supplied to second column 14 as reflux liquid 28.

To perform step (e), there may be used lines for dividing condensed liquid 27*b* of the second overhead vapor into two or more streams, and for obtaining mixed stream 23 of one (stream 29) of the divided streams and first overhead vapor 22 (these lines may be hereinafter called "dividing and mixing lines"). The dividing and mixing lines include a line from the condensed liquid outlet of condenser 11 to the juncture between stream 29 and stream 22 (drum 12 and pump 13 can be included). Further, the dividing and mixing lines include a line from the overhead of first column 3 to the juncture.

The dividing and mixing lines have a branch partway thereof, especially at the outlet of pump 13. A line from this branch to the overhead of the second column (line through which stream 28 flows) is used as a reflux line for performing step (h), namely a line for supplying another (stream other than stream 29) of the two or more streams obtained by dividing condensed liquid 27*b* to the second column as reflux liquid.

(f) A step of totally condensing mixed stream 23 obtained from step (e) by exchanging heat with the feed LNG (stream 21*a* which is pressurized if needed) in heat exchanger 2, to obtain liquid stream 23*a*.

Since stream 29 mainly including ethane is added to first overhead vapor 22 mainly including methane, the condensing temperature of mixed fluid 23 is relatively high. Therefore, first overhead vapor 22 (to which stream 29 is added) can be totally condensed without being compressed.

(g) A step of discharging the whole or a part of liquid stream 23*a* obtained from step (0, as product LNG (a liquid fraction enriched in methane and ethane).

The whole of totally condensed liquid stream 23*a* can be sent in the state of liquid to a vaporizer inlet of an LNG terminal, as product LNG.

Alternatively, a part of liquid stream 23*a* can be discharged as product LNG, and the remainder can be supplied to the first column (especially its overhead) as reflux liquid 24 (step (j)). In FIG. 4, liquid stream 23*a* is supplied to drum 9, and liquid stream 23*b* withdrawn from drum 9 is pressurized by pump (first column reflux pump) 6 and then divided into two streams. One stream is supplied to the first column as reflux liquid 24, and the other stream 25*a* is further pressurized by product LNG pump 10 and then discharged as product LNG 25.

A first discharge line (product LNG discharge line) used in step (g) is a line from the outlet of liquid stream 23*a* of heat exchanger 2 to a discharge port of product LNG. When a part of liquid stream 23*a* is discharged as product LNG, a branch can be provided partway of this line. A reflux line which supplies the remainder of liquid stream 23*a* to first column 3 as reflux liquid 24 can be connected with this branch. In FIG. 4, the product LNG discharge line is a line (including drum 9 and pumps 6 and 10) through which streams 23*a*, 23*b*, 25*a* and 25 flow, and has a branch between pump 6 and pump 10. A line which connects this branch and the overhead of first column 3 (line through which reflux liquid 24 flows) is a reflux line to the first column.

(h) A step of supplying another of the two or more streams obtained by dividing condensed liquid 27*b* in step (e) to second column 14 as reflux liquid 28. This step has already been described with step (e).

(i) A step of discharging second bottom liquid 30 as a liquid fraction enriched in the hydrocarbon having 3 or more carbon atoms.

Second bottom liquid 30 can be discharged as product LPG. A second discharge line (product LPG discharge line) used in this step is a line from the outlet of the bottom liquid of the second column to the product LPG discharge port. In FIG. 4, a product LPG discharge line is a line through which stream 30 flows.

In the process described above, the cold heat of feed LNG (stream 21*a*) is used in overhead condenser 2 of the first column, and the cold heat of the internal fluid of the first column is used in overhead condenser 11 of the second column. Therefore, external refrigeration is not required.

First column 3 includes reboiler (first column bottom reboiler) 4 at the bottom in addition to the side reboiler. Second column 14 includes reboiler (second column reboiler) 15 at the bottom. As heat sources of these bottom reboilers, an appropriate heating medium such as sea water, steam or hot oil is used depending on the temperature of the fluid to be heated.

Figure 5:
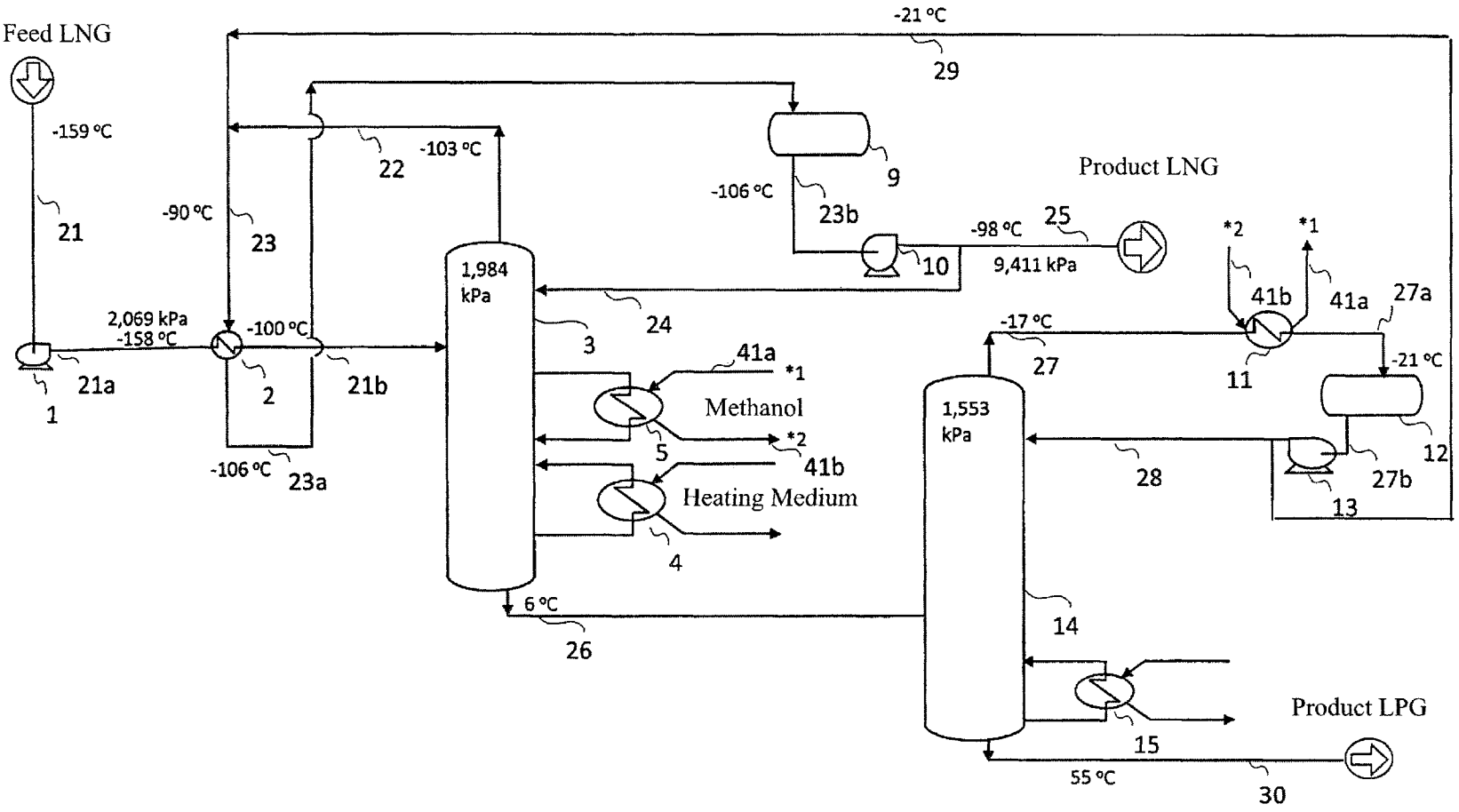
FIG. 5 is a process flow diagram illustrating another embodiment of a method for separating hydrocarbons of the present invention.

In the process shown in FIG. 5, the whole of liquid stream 23*b* withdrawn from drum 9 is pressurized by product LNG pump 10 and then divided. One stream 24 is refluxed to first column 3, and product LNG is obtained from another stream 25. Pump 6 shown in FIG. 4 is not used. The product LNG discharge line is a line through which streams 23*a*, 23*b*, and 25 flow (drum 9 and pump 10 are included), and has a branch between pump 10 and a product LNG discharge port. A line which connects this branch and the overhead of first column 3 (line through which reflux liquid 24 flows) is a reflux line to the first column. This process is the same as that shown in FIG. 4 except for the aforementioned points.

Figure 6:
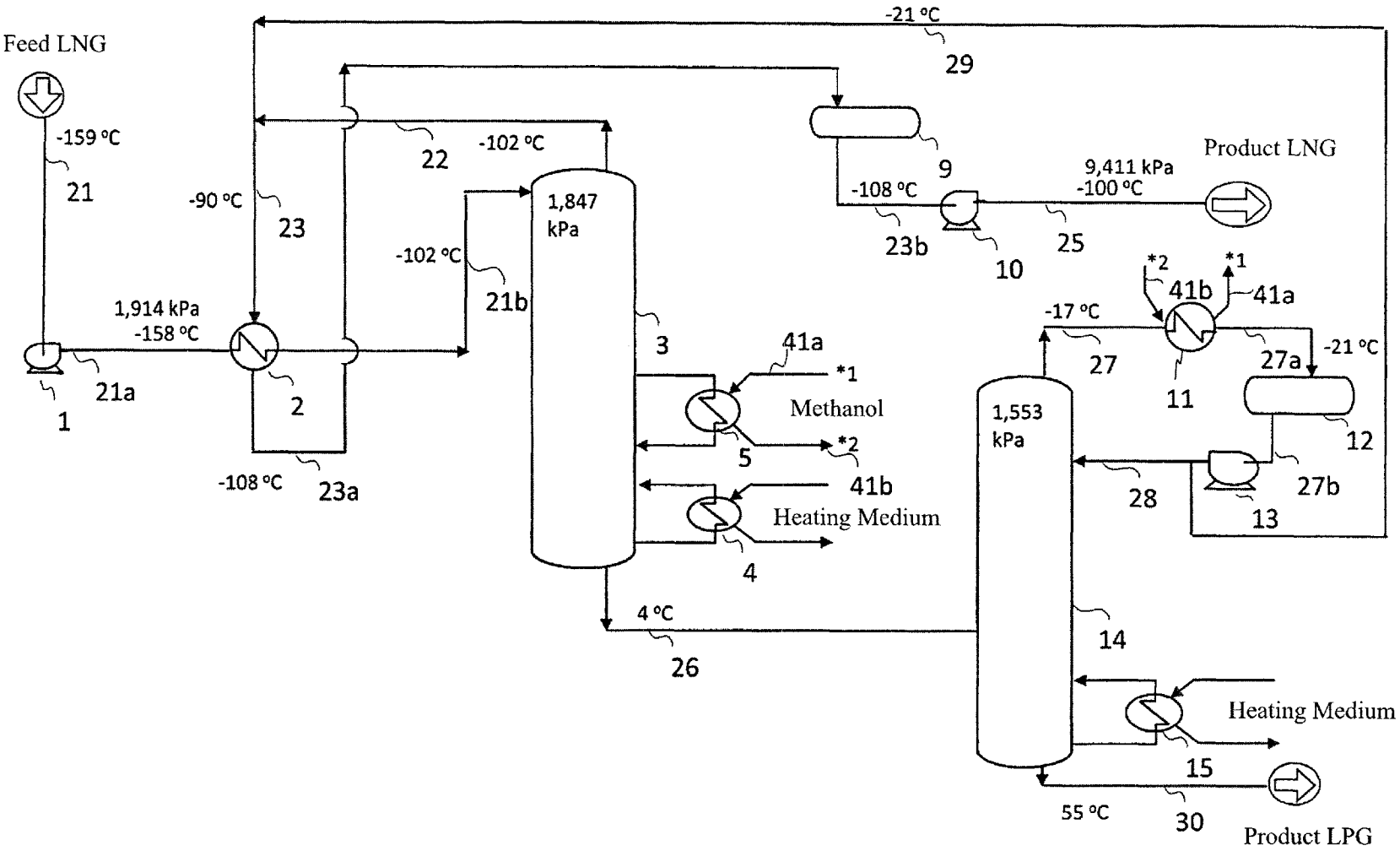
FIG. 6 is a process flow diagram illustrating yet another embodiment of a method for separating hydrocarbons of the present invention.

In the process shown in FIG. 6, the whole of liquid stream 23*b* withdrawn from drum 9 is pressurized by pump 10, and pressurized stream 25 is used as product LNG. Pump 6 shown in FIG. 4 is not used, and the reflux of first column 3 (stream 24) is not performed. Feed LNG is used as reflux liquid since product LNG is not used as reflux liquid. Therefore, feed LNG heated in heat exchanger 2 (vapor-liquid two-phase stream 21*b*) is supplied to the overhead of first column 3. The product LNG discharge line is a line through which streams 23*a*, 23*b* and 25 flow (drum 9 and pump 10 are included), and does not have a branch. This process is the same as that shown in FIG. 4 except for the aforementioned points.

Figure 7:
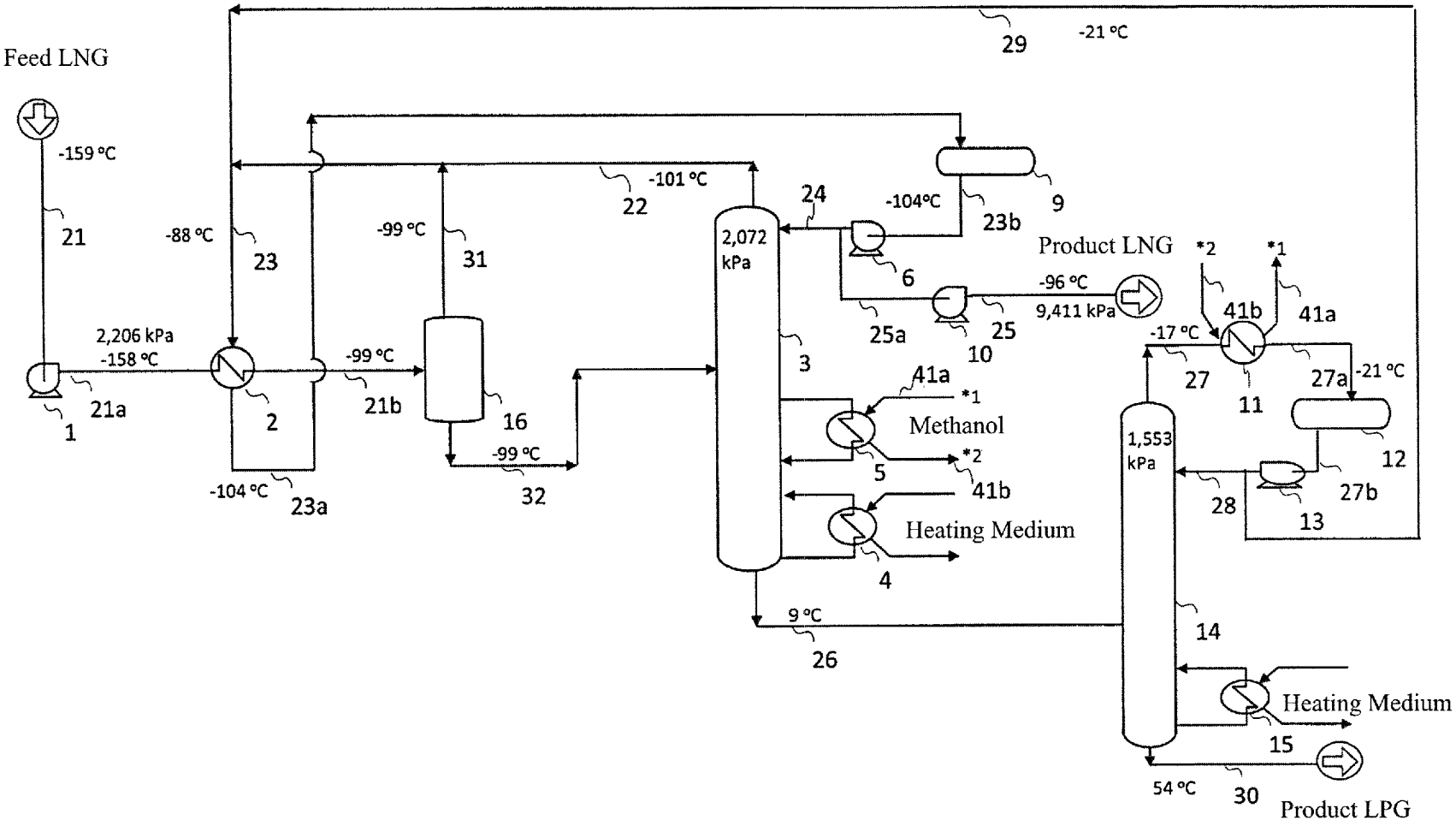
FIG. 7 is a process flow diagram illustrating yet another embodiment of a method for separating hydrocarbons of the present invention.

In the process shown in FIG. 7, the vapor-liquid separation of the heated feed LNG obtained from heat exchanger 2 (vapor-liquid two-phase stream 21*b*) is performed by separator 16. Liquid phase 32 obtained from separator 16 is supplied to first column 3, and vapor phase 31 is mixed with first overhead vapor 22. This separation apparatus has a line which connects the outlet of the vapor-liquid two-phase stream 21*b* of heat exchanger 2 to the inlet of separator 16. This apparatus has a line for supplying a liquid phase obtained from separator 16 to first column 3, namely a line from the liquid phase outlet of separator 16 to first column 3. Further, this apparatus has a line for mixing a vapor phase obtained from the separator with the first overhead vapor, namely a line from the vapor phase outlet of the separator to a juncture with stream 22. This process is the same as that shown in FIG. 4 except for the aforementioned points.

Figure 8:
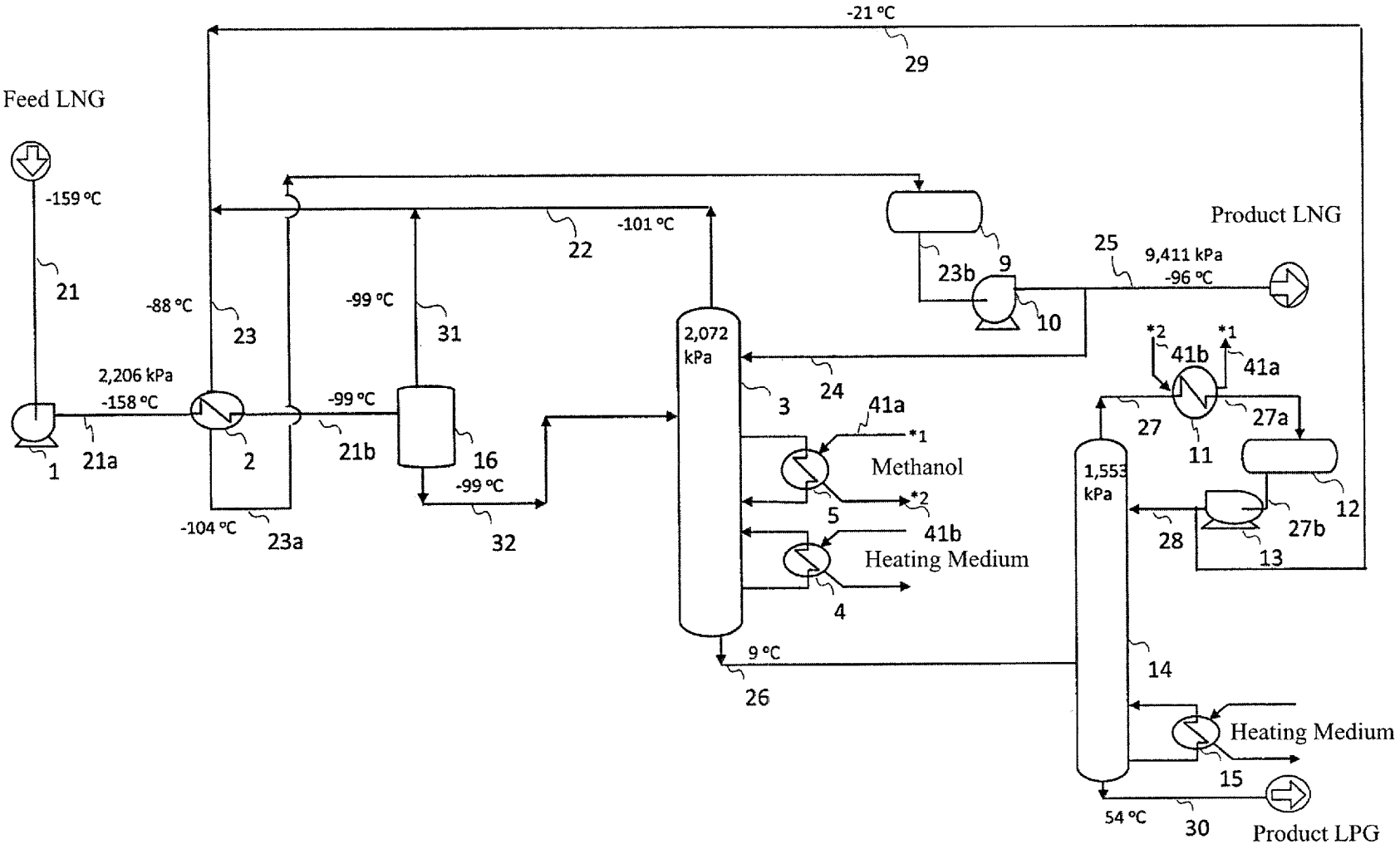
FIG. 8 is a process flow diagram illustrating yet another embodiment of a method for separating hydrocarbons of the present invention.

In the process shown in FIG. 8, the whole of liquid stream 23*b* withdrawn from drum 9 is pressurized by product LNG pump 10 and then divided. One stream 24 is refluxed to first column 3, and product LNG is obtained from the other stream 25. Pump 6 shown in FIG. 4 is not used. As to these points, this process is the same as the process shown in FIG. 5. The vapor-liquid separation of the feed LNG heated in heat exchanger 2 (vapor-liquid two-phase stream 21*b*) is performed by separator 16. Liquid phase 32 obtained from separator 16 is supplied to first column 3, and vapor phase 31 is mixed with first overhead vapor 22. As to these points, this process is the same as the process shown in FIG. 7. This process is the same as that shown in FIG. 4 except for the aforementioned points.

As another embodiment of the apparatus, a preheater (heat exchanger) for preheating feed LNG just before the LNG is supplied to first column 3 (stream 21*b* in FIGS. 4 to 6 or stream 32 in FIGS. 7 to 8) may be installed. That is, a heat exchanger (not shown), separately from heat exchanger 2 used in step (a), is provided downstream of heat exchanger 2 and upstream of first column 3. Using this heat exchanger (preheater), a step of heating the vapor-liquid two-phase stream obtained from step (a), namely the vapor-liquid two-phase stream obtained from heat exchanger 2, can be performed before step (b). The "upstream" and "downstream" mentioned here are based on the flow direction of the feed LNG stream.

By using utility at a low temperature level, such as sea water, as the heat source of this preheater, the duty of a heat source at a high temperature level which is necessary for bottom reboiler 4 of first column 3 can be reduced. Alternatively, the duty of bottom reboiler 4 of first column 3 may be reduced by using product LPG 30 as the heat source of this preheater.

Second overhead vapor 27 can be subcooled in step (d), that is, in condenser 11. Subcooling means totally condensing gas, and then further cooling the liquid after the condensation to lower its temperature. Thereby, for example, when heat is transferred between condenser 11 and side reboiler 5, the amount of heat supplied to side reboiler 5 can be increased. As a result, the required amount of heat of reboiler 4 can be reduced, and the energy consumption can be reduced.

As the composition of feed LNG becomes lighter, total condensation in first column overhead condenser 2 tends to become difficult. Therefore, the operating pressure of first column 3 can be adjusted properly depending on the composition of feed LNG. When partial ethane recovery is performed, the quantity of recycled ethane (stream 29) may decrease depending on the amount of ethane recovered. In that case, to totally condense the overhead vapor of first column 3, the operating pressure of first column 3 can be adjusted properly.

First column 3 and second column 14 may be vertically arranged and integrally joined, so that the resulting apparatus structure may look as if it were one-column distillation apparatus.

As to the structure and material of each of aforementioned instruments, such as a distillation column, heat exchanger, reboiler, condenser, separator, drum, and pump, a structure and material well-known in the field of separating hydrocarbons from feed LNG can be properly used. The instruments can be connected using proper lines and those lines can be formed using proper piping materials.

EXAMPLES

Process simulations were performed for the processes of Examples and Comparative Examples. The conditions, such as the composition, flow rate, temperature and pressure, of feed LNG were made the same in each example to compare energy consumption and equipment configuration. The composition of the feed LNG was 0.5% by mole of nitrogen, 86.7% by mole of methane, 8.9% by mole of ethane, 2.9% by mole of propane and 1.0% by mole of butane. The feed LNG is supplied at a flow rate of 10,979 kg-mol/hr, a temperature of −159° C., and a pressure of 125 kPaA. "A" in the pressure unit means absolute pressure. The unit "kg-mol" means "$10^3$ mol."

Any heat leak between the surroundings and the process equipment having very low temperatures is not taken into account for calculation, assuming that the amount of the heat leak is sufficiently small. The application of commercially available cold insulating materials to the equipment minimizes such heat leak and makes this assumption reasonable.

Comparative Example 1

Figure 1:
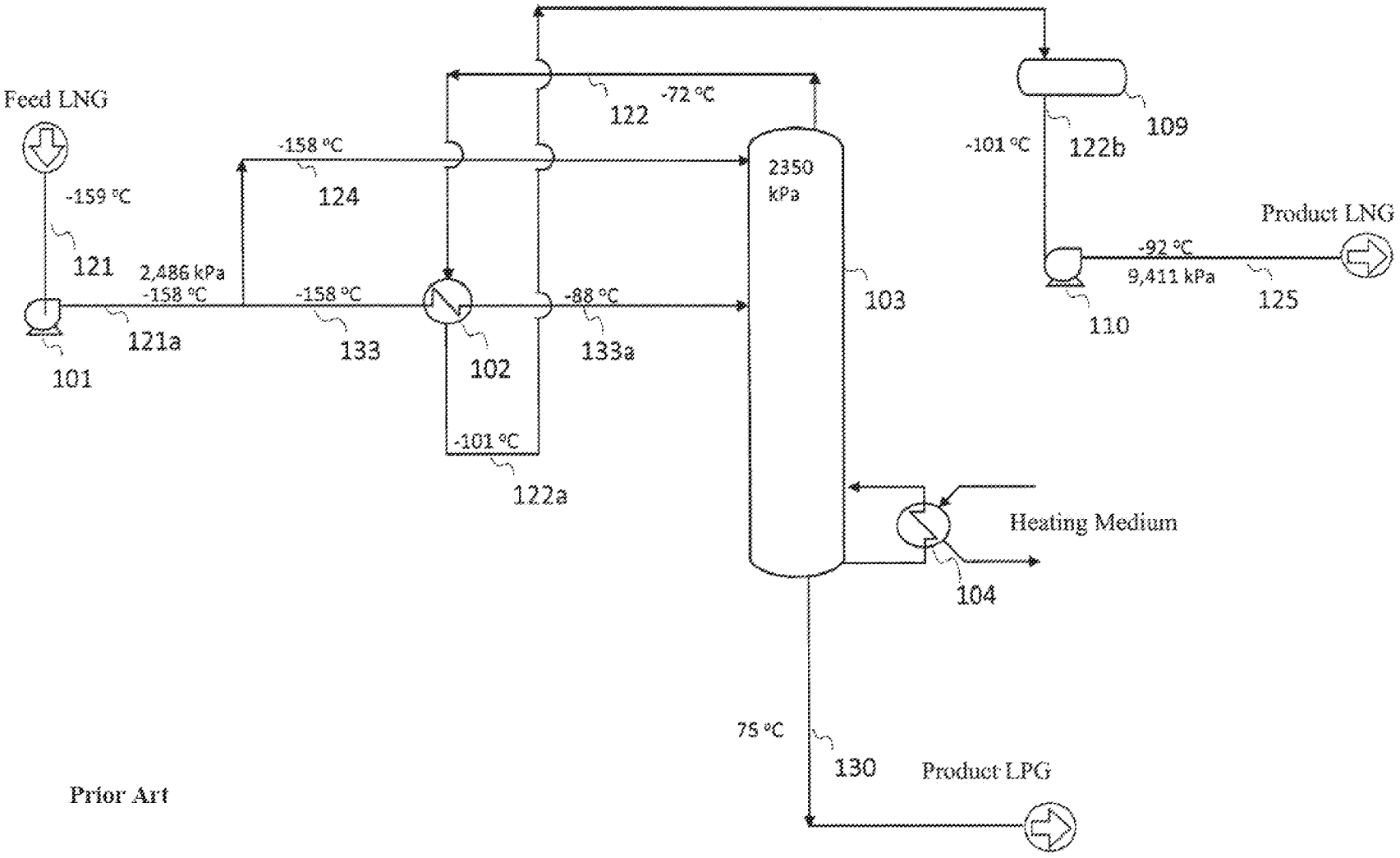
FIG.1 Prior Art
FIG. 1 is a process flow diagram illustrating a method for separating hydrocarbons of Comparative Example 1.

A process simulation was performed as to the process shown in FIG. 1, which is described in U.S. Pat. No. 6,510,706. A one-column separating apparatus was used in this example.

Feed LNG 121 at around −159° C. supplied from an LNG tank (not shown) is pressurized by feed LNG pump 101 (stream 121*a*), and a part thereof 133 is heated in heat exchanger (distillation column overhead condenser) 102 (stream 133*a*) and supplied to a middle of distillation column 103. Meanwhile, the remaining feed LNG is bypassed around distillation column overhead condenser 102, and is supplied to the top of distillation column 103 as reflux liquid 124.

Overhead vapor 122 of distillation column 103 is supplied to distillation column overhead condenser 102 at 2,350 kPaA and −72° C., cooled to −101° C. by heat exchange with feed LNG 133 and totally condensed. Totally condensed liquid 122*a* flows through distillation column reflux drum 109 (stream 122*b*), and is pressurized to a pipeline pressure of 9,411 kPaA by product LNG pump 110 and returned to an LNG terminal as product LNG 125.

The bottom liquid of distillation column 103 is at 75° C., and is heated in distillation column bottom reboiler 104 so that the C2/C3 molar ratio (ethane/propane molar ratio) in product LPG (C3+ NGL obtained as a bottom product) 130 is 0.02 or less. The material balance, the recovery rates and the energy consumption of this example are summarized on Table 1.

TABLE 1

Material Balance, Recovery Rate and Energy Consumption in Comparative Example 1 (Corresponding to FIG. 1)

| | Stream Flow Rate kg-moles/h | | | | |
|---|---|---|---|---|---|
| Stream | Methane | Ethane | Propane | Butane | Total |
| 121 | 9,524 | 977 | 322 | 109 | 10,979 |
| 122 | 9,524 | 971 | 12 | 1 | 10,555 |
| 124 | 1,238 | 127 | 42 | 14 | 1,427 |
| 125 | 9,524 | 971 | 12 | 1 | 10,555 |
| 130 | 0 | 6 | 310 | 108 | 424 |
| 133 | 8,286 | 850 | 280 | 95 | 9,552 |

TABLE 1-continued

| Material Balance, Recovery Rate and Energy Consumption in Comparative Example 1 (Corresponding to FIG. 1) | |
|---|---|
| Recovery Rate | |
| Propane | 96.28% |
| Butane | 99.13% |
| Required Power | |
| Feed LNG pump | 355 kW |
| Product LNG pump | 1,311 kW |
| Total | 1,666 kW |
| Supply of External Heat | |
| Distillation column bottom reboiler | 13,448 kW |
| Total | 13,448 kW |

Comparative Example 2

Figure 2:
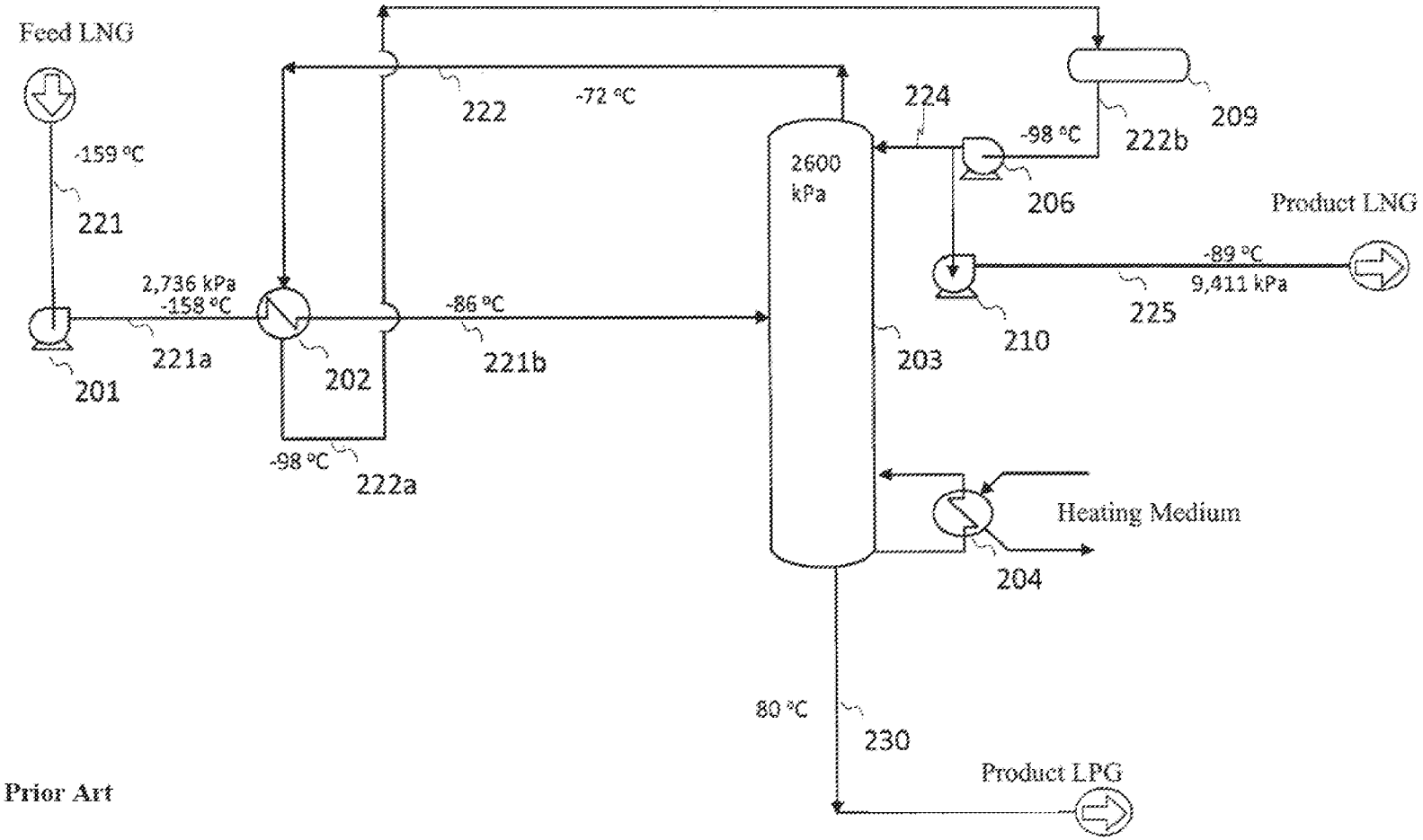
FIG.2 Prior Art
FIG. 2 is a process flow diagram illustrating a method for separating hydrocarbons of Comparative Example 2.

A process simulation was performed as to the process shown in FIG. 2, which is described in U.S. Pat. No. 2,952,984. A one-column separating apparatus is used in this example.

Feed LNG 221 at around −159° C. supplied from an LNG tank (not shown) is pressurized by feed LNG pump 201 (stream 221*a*), heated in heat exchanger (distillation column overhead condenser) 202 (stream 221*b*) and supplied to a middle of distillation column 203. In distillation column overhead condenser 202, the feed LNG gives its cold heat to overhead vapor 222 of distillation column 203, and the feed LNG is heated to −86° C.

Overhead vapor 222 of distillation column 203 is supplied to distillation column overhead condenser 202 at 2,600 kPaA and −72° C., cooled to −98° C. by heat exchange with feed LNG 221*a* and totally condensed. Totally condensed liquid 222*a* flows through distillation column reflux drum 209 (stream 222*b*), and is pressurized by distillation column reflux pump 206, and a part thereof is supplied to the top of distillation column 203 as reflux liquid 224. The remaining liquid is pressurized to a pipeline pressure of 9,411 kPaA by product LNG pump 210 and returned to an LNG terminal as product LNG 225.

The bottom liquid of distillation column 203 is at 80° C., and is heated in distillation column bottom reboiler 204 so that the C2/C3 molar ratio in product LPG 230, which is a bottom product, is 0.02 or less. The material balance, the recovery rates and the energy consumption of this example are summarized on Table 2.

TABLE 2

Material Balance, Recovery Rate and Energy Consumption in Comparative Example 2 (Corresponding to FIG. 2)

| | Stream Flow Rate kg-moles/h | | | | |
|---|---|---|---|---|---|
| Stream | Methane | Ethane | Propane | Butane | Total |
| 221 | 9,524 | 977 | 322 | 109 | 10,979 |
| 222 | 11,205 | 1,142 | 2 | 0 | 12,404 |
| 224 | 1,681 | 171 | 0 | 0 | 1,861 |
| 225 | 9,524 | 971 | 1 | 0 | 10,543 |
| 230 | 0 | 6 | 320 | 109 | 436 |

| Recovery Rate | |
|---|---|
| Propane | 99.47% |
| Butane | 100.00% |

TABLE 2-continued

| Material Balance, Recovery Rate and Energy Consumption in Comparative Example 2 (Corresponding to FIG. 2) | |
|---|---|
| Required Power | |
| Feed LNG pump | 393 kW |
| Distillation column reflux pump | 22 kW |
| Product LNG pump | 1,272 kW |
| Total | 1,687 kW |
| Supply of External Heat | |
| Distillation column bottom reboiler | 14,319 kW |
| Total | 14,319 kW |

Since the condensed liquid of the overhead vapor of the first column is used as reflux liquid in this example, a higher propane recovery rate 99.47% has been achieved than 96.28% in Comparative Examples 1.

Comparative Example 3

Figure 3:
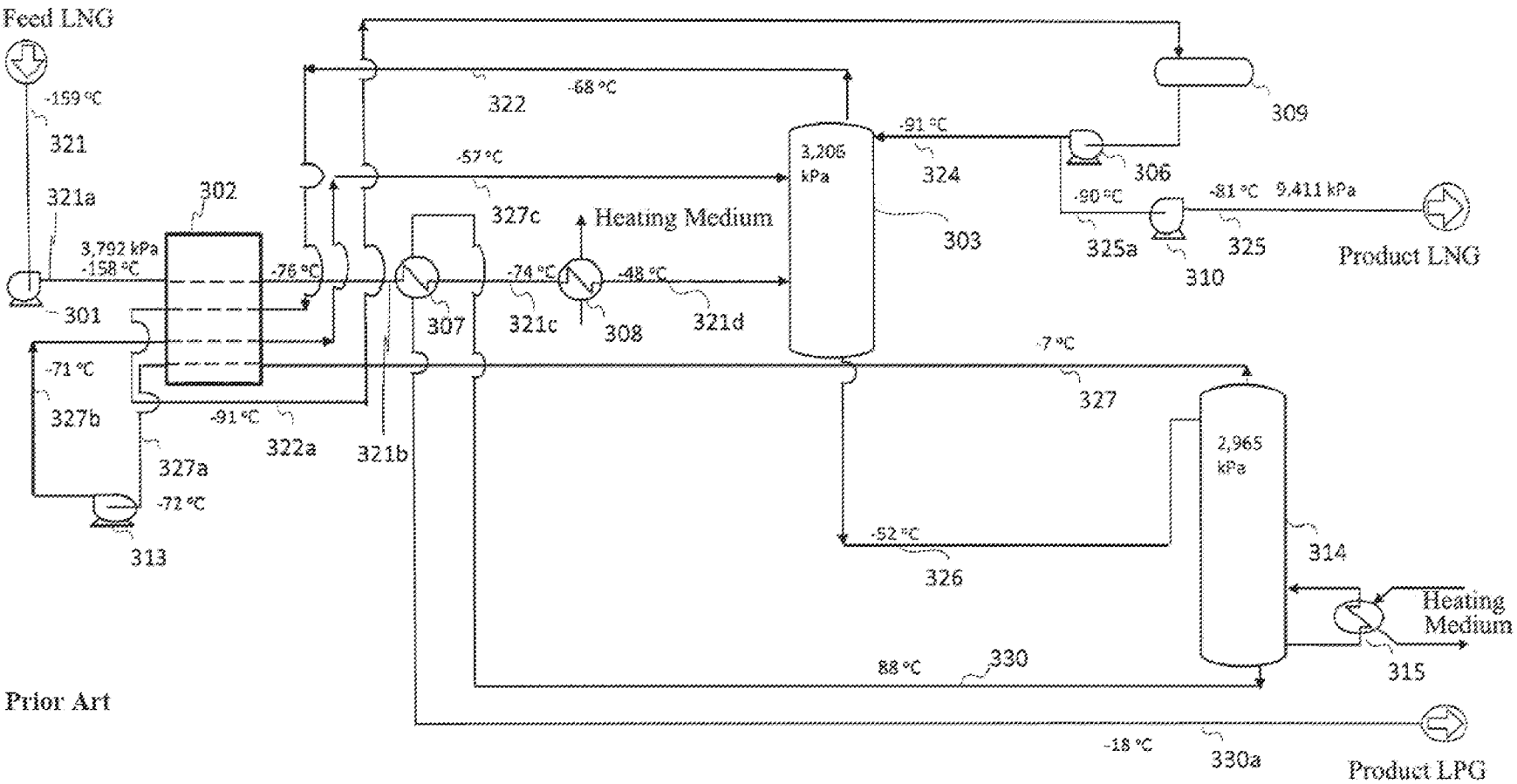
FIG.3 Prior Art
FIG. 3 is a process flow diagram illustrating a method for separating hydrocarbons of Comparative Example 3.

A process simulation was performed as to the process shown in FIG. 3, which is described in U.S. Pat. No. 7,216,507. A two-column separating apparatus is used in this example.

Feed LNG 321 at around −159° C. supplied from an LNG tank (not shown) is pressurized by feed LNG pump 301 (stream 321*a*), flows through heat exchanger (first column overhead condenser) 302 (stream 321*b*), through cold heat recovery exchanger 307 (stream 321*c*) and further through feed LNG preheater 308 (stream 321*d*), and is supplied to the middle of first column 303. In first column overhead condenser 302, the feed LNG is heated to −76° C. by giving its cold heat to overhead vapor 322 of the first column. Further, the feed LNG is heated to −74° C. by giving cold heat to product LPG 330 from the bottom of second column 314 in cold heat recovery exchanger 307, and then heated to −48° C. by an external heat source (heating medium) in feed LNG preheater 308. The heated feed LNG is then supplied to first column 303, and brought into direct contact with liquid coming from the upper part of the column. Thereby, C3+ NGL components of the feed LNG are absorbed in the liquid phase. Overhead vapor 322 of distillation column 303 is supplied to distillation column overhead condenser 302 at −68° C. and 3,206 kPaA, cooled to −91° C. by the cold heat of the feed LNG as mentioned above and totally condensed. Totally condensed liquid 322*a* flows through reflux drum 309 and first column reflux pump 306, and a part thereof is supplied to the overhead of first column 303 as reflux liquid 324. Remaining liquid 325*a* is pressurized to a pipeline pressure of 9,411 kPaA by product LNG pump 310 and returned to an LNG terminal as product LNG 325. Bottom liquid 326 of first column 303 is supplied to second column 314 at −52° C. and 2,965 kPaA by its own pressure. In second column 314, vapor of methane and ethane is generated by heat supplied by second column reboiler 315, and distillation operation is performed so that C2/C3 molar ratio in bottom liquid 330 is 0.02 or less. The product LPG flows from the bottom of second column 314 to cold heat recovery exchanger 307 at 88° C., and is subcooled to −18° C. by feed LNG 321*b* and discharged out of the system as product LPG 330*a*. Overhead vapor 327 of second column 314 is supplied at −7° C. to first column overhead condenser 302, cooled to −72° C., and totally condensed. Totally condensed liquid 327*a* is pressurized by second column reflux pump 313

(stream 327*b*), then returned to first column overhead condenser 302 and heated to −57° C. by giving its own latent heat to become vapor-liquid two-phase stream 327*c*, a part of which is vapor. This vapor-liquid two-phase stream 327*c* is supplied to first column 303 as the second reflux liquid of the first column. The second reflux liquid has the function of absorbing propane and heavier hydrocarbons contained in the vapor inside the first column and concentrating C3+ NGL components in the liquid inside the column. The material balance, the recovery rate and the energy consumption of this example are summarized on Table 3.

TABLE 3

Material Balance, Recovery Rate and Energy Consumption in Comparative Example 3 (Corresponding to FIG. 3)

| | Stream Flow Rate kg-moles/h | | | | |
|---|---|---|---|---|---|
| Stream | Methane | Ethane | Propane | Butane | Total |
| 321 | 9,524 | 977 | 322 | 109 | 10,979 |
| 322 | 10,934 | 1,115 | 4 | 0 | 12,107 |
| 324 | 1,410 | 144 | 1 | 0 | 1,562 |
| 325 | 9,524 | 971 | 3 | 0 | 10,545 |
| 326 | 582 | 458 | 396 | 116 | 1,552 |
| 327 | 582 | 452 | 77 | 7 | 1,118 |
| 330 | 0 | 6 | 319 | 109 | 434 |

| Recovery Rate | |
|---|---|
| Propane | 99.03% |
| Butane | 100.00% |
| **Required Power** | |
| Feed LNG pump | 534 kW |
| First column reflux pump | 110 kW |
| Second column reflux pump | 18 kW |
| Product LNG pump | 1,251 kW |
| Total | 1,913 kW |
| **Supply of External Heat** | |
| Feed LNG preheater | 9,010 kW |
| Second column reboiler | 5,292 kW |
| Total | 14,302 kW |

Example 1

A process simulation was performed as to the process shown in FIG. 4 according to the present invention.

Feed LNG 21 is supplied at around −159° C., pressurized by feed LNG pump 1, and sent to first column 3 having an operating pressure of 1,984 kPaA. Pressurized feed LNG 21*a* gives cold heat to stream 23 in heat exchanger (first column overhead condenser) 2, and feed LNG 21*a* is heated to −100° C. Heated feed LNG (vapor-liquid two-phase stream) 21*b* is supplied to a middle of first column 3. Thereafter, in this column, the vapor flows up and is brought into direct contact with liquid coming from the upper part of the column. Thereby, C2+ NGL components of the feed LNG are absorbed in the liquid phase. Overhead vapor 22 is withdrawn from first column 3 at −103° C. and mixed with a part of ethane (stream 29) having a temperature of −21° C., which is obtained by condensing the overhead vapor of second column 14, and reaches −90° C. Mixed stream 23 is supplied to first column overhead condenser 2, cooled to −106° C. by exchanging heat with pressurized feed LNG 21*a* and totally condensed. Totally condensed liquid 23*a* flows through drum (first column reflux drum) 9 (stream 23*b*), and is pressurized by first column reflux pump 6, and a part thereof is supplied to the overhead of the first column as reflux liquid 24. The reflux liquid has the function of absorbing C2+ NGL components and concentrating the components in the liquid inside the column. Remaining condensed liquid 25*a* is pressurized to a pipeline pressure of 9,411 kPaA by product LNG pump 10 and returned to an LNG terminal as product LNG 25. Heat is given to bottom liquid 26 of first column 3 by first column bottom reboiler 4, and bottom liquid 26 reaches 6° C. under the condition that the C1/C2 molar ratio (methane/ethane molar ratio) is 0.014. This bottom liquid 26 is supplied to second column 14 having an operating pressure of 1,553 kPaA. In second column 14, methane and ethane fractions are stripped by giving heat by second column reboiler 15, which allows the C2/C3 molar ratio in bottom product LPG 30 to be 0.02 or less. Under the condition of operating pressure 1,553 kPaA, the bottom temperature of the second column is 55° C. Overhead vapor 27 of second column 14 is supplied at −17° C. to second column overhead condenser 11, cooled to −21° C. and totally condensed. Condensed liquid (ethane liquid) 27*a* flows through drum 12 (stream 27*b*), and is pressurized by second column reflux pump 13. The pressurized fluid is divided into two streams. One stream is supplied to second column 14 as reflux liquid 28, and the other stream (stream 29) is mixed into overhead vapor 22 of first column 3 as mentioned above.

According to this process, a system without external refrigeration is obtained by using the cold heat of first column 3 as the cold heat source of second column overhead condenser 11 as mentioned above. To transfer the cold heat of first column 3 to the overhead vapor of second column 14, anti-freezing liquid such as methanol is used as an indirect heating medium and circulated between first column side reboiler 5 and second column overhead condensers 11. First column side reboiler 5 also contributes to reducing the heat duty of first column bottom reboiler 4. The material balance, the recovery rates and the energy consumption of this example are summarized on Table 4.

TABLE 4

Material Balance, Recovery Rate and Energy Consumption in Example 1 (Corresponding to FIG. 4)

| | Stream Flow Rate kg-moles/h | | | | |
|---|---|---|---|---|---|
| Stream | Methane | Ethane | Propane | Butane | Total |
| 21 | 9,524 | 977 | 322 | 109 | 10,979 |
| 22 | 9,908 | 95 | 0 | 0 | 10,051 |
| 23 | 9,921 | 1,011 | 2 | 0 | 10,983 |
| 24 | 397 | 41 | 0 | 0 | 439 |
| 25 | 9,524 | 971 | 2 | 0 | 10,544 |
| 26 | 13 | 923 | 322 | 109 | 1,367 |
| 29 | 13 | 917 | 2 | 0 | 932 |
| 30 | 0 | 6 | 320 | 109 | 435 |

| Recovery Rate | |
|---|---|
| Propane | 99.31% |
| Butane | 100.00% |
| **Required Power** | |
| Feed LNG pump | 292 kW |
| First column reflux pump | 18 kW |
| Second column reflux pump | 21 kW |
| Product LNG pump | 1,319 kW |
| Total | 1,650 kW |

TABLE 4-continued

| Material Balance, Recovery Rate and Energy Consumption in Example 1 (Corresponding to FIG. 4) | |
|---|---|
| Supply of External Heat | |
| First column bottom reboiler | 6,896 kW |
| Second column reboiler | 5,144 kW |
| Total | 12,040 kW |

The recovery rates and the like of Example 1 shown in Table 4 are compared with those of Comparative Examples 1 to 3 shown in Tables 1, 2 and 3. First, a higher propane recovery rate of 99.31% is achieved in Example 1 (Table 4) than a propane recovery rate in Comparative Example 1 (Table 1), 96.28%. It can be understood that this is because the overhead vapor is used as the reflux liquid, and thereby, a higher reflux effect is obtained.

The propane recovery rates of Comparative Examples 2 and 3 (Tables 2 and 3) are 99.47% and 99.03%, respectively. It can be said that Example 1 (Table 4) have achieved an almost equivalent propane recovery rate of 99.31%.

Meanwhile, when reboiler heat duties are compared, the reboiler heat duty is 12,040 kW in Example 1 (Table 4), which is 16% lower than 14,319 kW and 14,302 kW of Comparative Examples 2 and 3 (Tables 2 and 3), respectively. The total pump power is 1,650 kW in Example 1 (Table 4), which is lower than 1,687 kW and 1,913 kW of Comparative Examples 2 and 3 (Tables 2 and 3), respectively.

The operating pressure of first column 3 is 1,984 kPaA in Example 1, which is reduced lower than any of 2,350 kPaA, 2,600 kPaA and 3,206 kPaA of Comparative Examples 1, 2 and 3, respectively. Therefore, the separation efficiency is improved, the load in the column can be reduced, and the wall thickness of the pressure vessel of the first column 3 can be thinner. When the flow rates of overhead vapor 22, 122, 222 and 322 are compared, 10,051 kg-moles/h of Example 1 (Table 4) is lower than any of 10,555 kg-moles/h, 12,404 kg-moles/h and 12,107 kg-moles/h of Comparative Examples 1, 2 and 3, respectively.

In the process of this example, the separation efficiency is improved mainly by the following three factors. First, first column 3 is relatively small due to using a two-column separating apparatus, while a one-column separating apparatus is used in Comparative Examples 1 and 2. By stripping and vaporizing only mainly methane, instead of both methane and ethane, in the first column, the load in the column is reduced.

Second, the propane concentration in the second column overhead vapor can be reduced lower than that of the two-column apparatus of Comparative Example 3 by installing overhead condenser 11 in second column 14. Therefore, the propane concentration in reflux liquid 24 to the first column can be lowered (while the propane concentration is 0.03% by mole in stream 322 of Comparative Example 3, the propane concentration of stream 23 of Example 1 is 0.018% by mole). Providing overhead condenser 11 and reflux 28 in second column 14 enables increasing the ethane purity and reducing the propane concentration in overhead stream 27 of second column 14.

The third point, which is the most important, is that a part (stream 29) of liquid obtained by condensing overhead vapor 27 of the second column is mixed with overhead vapor 22 of first column 3 to raise the condensing temperature of this overhead vapor. By raising the condensing temperature, this overhead vapor can be totally condensed at a pressure of 1,984 kPaA in Example 1, which is lower than 3,206 kPaA of Comparative Example 3. By reducing the operating pressure of first column 3, the separation efficiency can be increased, the load in first column 3 can be reduced, and the flow rate of overhead vapor 22 can be reduced, and its condensation can be easily facilitated. In addition, the wall thickness required for the pressure vessel of first column 3 can be thinner.

Example 2

A process simulation was performed as to the process shown in FIG. 5 according to the present invention. In this process, pump (first column reflux pump) 6 is removed from the process shown in FIG. 4 as mentioned above. The material balance, the recovery rates and the energy consumption of this example are summarized on Table 5.

TABLE 5

Material Balance, Recovery Rate and Energy Consumption in Example 2 (Corresponding to FIG. 5)

| | Stream Flow Rate kg-moles/h | | | | |
|---|---|---|---|---|---|
| Stream | Methane | Ethane | Propane | Butane | Total |
| 21 | 9,524 | 977 | 322 | 109 | 10,979 |
| 22 | 9,908 | 97 | 0 | 0 | 10,054 |
| 23 | 9,921 | 1,011 | 2 | 0 | 10,983 |
| 24 | 397 | 41 | 0 | 0 | 439 |
| 25 | 9,524 | 971 | 2 | 0 | 10,544 |
| 26 | 13 | 920 | 322 | 109 | 1,364 |
| 29 | 13 | 914 | 2 | 0 | 929 |
| 30 | 0 | 6 | 320 | 109 | 435 |
| Recovery Rate | | | | | |
| Propane | | | | 99.31% | |
| Butane | | | | 100.00% | |
| Required Power | | | | | |
| Feed LNG pump | | | | 292 kW | |
| Second column reflux pump | | | | 21 kW | |
| Product LNG pump | | | | 1,392 kW | |
| Total | | | | 1,705 kW | |
| Supply of External Heat | | | | | |
| First column bottom reboiler | | | | 6,856 kW | |
| Second column reboiler | | | | 5,131 kW | |
| Total | | | | 11,987 kW | |

The propane recovery rate of Example 2 (Table 5) is 99.31%, and is the same as that of Example 1 (Table 4). Meanwhile, first column reflux pump 6 is removed, and a part of LNG pressurized by product LNG pump 10 is supplied as reflux liquid of the first column instead, in this example. Therefore, the total pump power is 1,705 kW in Example 2 (Table 5), which is 3% higher than 1,650 kW of Example 1 (Table 4). In Example 2, since the pressurization by pump 10 is performed to achieve a higher pressure than a pressure required for the reflux, the temperature of reflux liquid 24 becomes higher, and therefore the heat duty of the first column bottom reboiler is reduced from 6,896 kW (Example 1) to 6,856 kW, that is, by 1%. The choice between the embodiments of Examples 1 and 2 depends on costs of energy consumption and capital investment.

Example 3

A process simulation was performed as to the process shown in FIG. 6 according to the present invention. In this process, pump (first column reflux pump) 6 and reflux liquid 24 to first column 3 are removed from the process shown in FIG. 4 as mentioned above. The material balance, the recovery rates and the energy consumption of this example are summarized on Table 6.

TABLE 6

Material Balance, Recovery Rate and Energy Consumption in Example 3 (Corresponding to FIG. 6)

| Stream | Stream Flow Rate kg-moles/h | | | | |
|---|---|---|---|---|---|
| | Methane | Ethane | Propane | Butane | Total |
| 21 | 9,524 | 977 | 322 | 109 | 10,979 |
| 22 | 9,511 | 85 | 3 | 0 | 9,647 |
| 23 | 9,524 | 971 | 6 | 0 | 10,548 |
| 25 | 9,524 | 971 | 6 | 0 | 10,548 |
| 26 | 13 | 892 | 319 | 109 | 1,332 |
| 29 | 13 | 886 | 2 | 0 | 901 |
| 30 | 0 | 6 | 316 | 109 | 431 |

| Recovery Rate | |
|---|---|
| Propane | 98.26% |
| Butane | 99.77% |

| Required Power | |
|---|---|
| Feed LNG pump | 269 kW |
| Second column reflux pump | 15 kW |
| Product LNG pump | 1,346 kW |
| Total | 1,630 kW |

| Supply of External Heat | |
|---|---|
| First column bottom reboiler | 6,504 kW |
| Second column reboiler | 5,105 kW |
| Total | 11,609 kW |

The propane recovery rate of Example 3 (Table 6) is 98.26%, which is a little lower than 99.31% of Examples 1 (Table 4). The butane recovery rate is 99.77% in Example 3, which is lower than 100.00% in Example 1. This means that since there is no reflux liquid 24 of first column 3, propane and butane from the overhead of first column 3 are mixed into the product LNG. Meanwhile, since there is no reflux of first column 3, the total pump power is 1,630 kW in Example 3 (Table 6), which is 4% lower than 1,705 kW of Example 2 (Table 5). Since the propane concentration in overhead vapor 22 of first column 3 is high in Example 3 (FIG. 6) and overhead vapor 22 is easy to condense, the operating pressure of first column 3 can be set at 1,847 kPaA, which is a little lower than 1,984 kPaA of Examples 1 and 2 (FIGS. 4 and 5). Separation efficiency is improved when the operating pressure is lower. Therefore, the heat duty of the first column bottom reboiler is reduced from 6,856 kW (Example 2) to 6,504 kW (Example 3), that is, by 5%. The choice amongst the embodiments of Example 3 (FIG. 6) and Examples 1 and 2 (FIGS. 4 and 5) depends on costs of energy consumption and capital investment.

Example 4

A process simulation was performed as to the process shown in FIG. 7 according to the present invention. In this process, feed LNG separator 16 is added to the process shown in FIG. 4 as mentioned above. The load in first column 3 can be reduced by installing feed LNG separator 16 upstream (upstream as to the direction of a stream of feed LNG) of first column 3 and by bypassing the vapor separated by separator 16 around first column 3. The material balance, the recovery rates and the energy consumption of this example are summarized on Table 7.

TABLE 7

Material Balance, Recovery Rate and Energy Consumption in Example 4 (Corresponding to FIG. 7)

| Stream | Stream Flow Rate kg-moles/h | | | | |
|---|---|---|---|---|---|
| | Methane | Ethane | Propane | Butane | Total |
| 21 | 9,524 | 977 | 322 | 109 | 10,979 |
| 22 | 5,772 | 57 | 0 | 0 | 5,841 |
| 23 | 9,694 | 990 | 4 | 0 | 10,736 |
| 24 | 194 | 20 | 0 | 0 | 215 |
| 25 | 9,524 | 971 | 4 | 0 | 10,546 |
| 26 | 13 | 901 | 320 | 109 | 1,343 |
| 29 | 13 | 895 | 2 | 0 | 910 |
| 30 | 0 | 6 | 318 | 109 | 433 |
| 31 | 3,972 | 39 | 2 | 0 | 4,050 |
| 32 | 5,552 | 938 | 320 | 109 | 6,929 |

| Recovery Rate | |
|---|---|
| Propane | 98.76% |
| Butane | 99.86% |

| Required Power | |
|---|---|
| Feed LNG pump | 313 kW |
| First column reflux pump | 18 kW |
| Second column reflux pump | 24 kW |
| Product LNG pump | 1,310 kW |
| Total | 1,665 kW |

| Supply of External Heat | |
|---|---|
| First column bottom reboiler | 7,350 kW |
| Second column reboiler | 4,979 kW |
| Total | 12,329 kW |

The propane recovery rate of Example 4 (Table 7) is 98.76%, which is a little lower than 99.31% of Examples 1 (Table 4). The butane recovery rate is 99.86%, which is also lower than 100.00% of Example 1 (Table 4).

Meanwhile, the propane and the butane recovery rates are equivalent to those (98.26%, 99.77%) of Example 3 (Table 6) or improved a little further than those of Example 3 (Table 6). This is because the amounts of propane and butane which are lost from overhead vapor (stream 31, which bypasses first column 3) of the feed LNG separator are less than the amounts of propane and butane which are lost from the overhead of first column 3 in the process of Example 3 in which reflux liquid 24 is not used.

In the case of Example 4 (Table 7), the flow rate of feed LNG (stream 32) supplied to first column 3 is 6,929 kg-moles/h, which is only 63% of the flow rate 10,979 kg-moles/h of feed LNG 21 of Example 3 (Table 6). Therefore, the load of first column 3 can be reduced, and the dimension of the first column 3 can be reduced.

In Example 4 (Table 7), since there is reflux pump 6 of first column 3, the total pump power is 1,665 kW, which is 2% higher than 1,630 kW of Example 3 (Table 6).

Since the propane concentration in overhead vapor 22 of the first column 3 is low in Example 4 (FIG. 7) and this vapor 22 is hardly condensed, the operating pressure of first column 3 have to be increased to 2,072 kPaA, which is higher than 1,847 kPaA of Example 3 (FIG. 6). Therefore, the heat duty of first column bottom reboiler 4 is 7,350 kW in Example 4 (Table 7), which is 13% higher than 6,504 kW of Example 3 (Table 6). The choice amongst the embodiments of Example 4 (FIG. 7) and Examples 1 to 3 (FIGS. 4, 5 and 6) depends on costs of energy consumption and capital investment.

Example 5

A process simulation was performed as to the process shown in FIG. 8 according to the present invention. In this process, feed LNG separator 16 is added in the same way as in Example 4 (FIG. 7) and pump (first column reflux pump) 6 is removed in the same way as in Example 2 (FIG. 5) as mentioned above, and separation is performed. The material balance, the recovery rates and the energy consumption of this example are summarized on Table 8.

TABLE 8

Material Balance, Recovery Rate and Energy Consumption in Example 5 (Corresponding to FIG. 8)

| | Stream Flow Rate kg-moles/h | | | | |
|---|---|---|---|---|---|
| Stream | Methane | Ethane | Propane | Butane | Total |
| 21 | 9,524 | 977 | 322 | 109 | 10,979 |
| 22 | 5,772 | 57 | 0 | 0 | 5,841 |
| 23 | 9,694 | 990 | 4 | 0 | 10,736 |
| 24 | 194 | 20 | 0 | 0 | 215 |
| 25 | 9,500 | 970 | 4 | 0 | 10,522 |
| 26 | 13 | 901 | 320 | 109 | 1,343 |
| 29 | 13 | 895 | 2 | 0 | 910 |
| 30 | 0 | 6 | 318 | 109 | 433 |
| 31 | 3,972 | 39 | 2 | 0 | 4,050 |
| 32 | 5,552 | 938 | 320 | 109 | 6,929 |

| Recovery Rate | |
|---|---|
| Propane | 98.76% |
| Butane | 99.86% |

| Required Power | |
|---|---|
| Feed LNG pump | 313 kW |
| Second column reflux pump | 24 kW |
| Product LNG pump | 1,354 kW |
| Total | 1,691 kW |

| Supply of External Heat | |
|---|---|
| First column bottom reboiler | 7,319 kW |
| Second column reboiler | 4,973 kW |
| Total | 12,292 kW |

The propane recovery rate of Example 5 (Table 8) is 98.76%, which is the same as that of Example 4 (Table 7). Meanwhile, first column reflux pump 6 is removed, and a part of LNG pressurized by product LNG pump 10 instead is supplied as reflux liquid of the first column. Therefore, the total pump power is 1,691 kW in Example 5 (Table 8), which is 2% higher than 1,665 kW of Example 4 (Table 7). In Example 5, since the pressurization by pump 10 is performed to achieve a higher pressure than a pressure required for the reflux, the temperature of reflux liquid 24 becomes higher, and therefore the heat duty of first column bottom reboiler 4 is reduced from 7,350 kW (Example 4) to 7,319 kW (Example 5), that is, by 1%.

The choice between the embodiments of Example 5 (FIG. 8) and Example 4 (FIG. 7) depends on costs of energy consumption and capital investment.

REFERENCE SIGNS LIST

1: feed LNG pump, 2: heat exchanger (first column overhead condenser), 3: first column, 4: first column bottom reboiler, 5: first column side reboiler, 6: first column reflux pump, 9: first column reflux drum, 10: product LNG pump, 11: second column overhead condenser, 12: second column reflux drum, 13: second column reflux pump, 14: second column, 15: second column reboiler, 16: feed LNG separator, 21: feed LNG, 21*b*: vapor-liquid two-phase stream of feed LNG, 22: first overhead vapor, 25: product LNG, 26: first bottom liquid, 27: second overhead vapor, 27*b*: condensed liquid obtained from second overhead vapor, 30: second bottom liquid (product LPG).

What is claimed is:

1. A method for separating hydrocarbons, wherein feed liquefied natural gas containing methane, ethane, and a hydrocarbon having 3 or more carbon atoms, including at least propane, is separated into a liquid fraction enriched in methane and ethane and a liquid fraction enriched in the hydrocarbon having 3 or more carbon atoms, wherein the method comprises:

(a) heating the feed liquefied natural gas in a heat exchanger to partially vaporize the feed liquefied natural gas to obtain a vapor-liquid two-phase stream;

(b) supplying the whole or a liquid phase of the vapor-liquid two-phase stream to a first distillation column and separating the supplied whole or liquid phase of the vapor-liquid two-phase stream into a first overhead vapor enriched in methane and a first bottom liquid enriched in ethane and the hydrocarbon having 3 or more carbon atoms by the first distillation column;

(c) separating the first bottom liquid into a second overhead vapor enriched in ethane and a second bottom liquid enriched in the hydrocarbon having 3 or more carbon atoms by a second distillation column;

(d) cooling the second overhead vapor to condense the whole or a part of the second overhead vapor to obtain a condensed liquid;

(e) dividing the condensed liquid into two or more streams, and obtaining a mixed stream of one of the divided streams and the first overhead vapor;

(f) totally condensing the mixed stream obtained from step (e) by exchanging heat with the feed liquefied natural gas in the heat exchanger used in step (a), to obtain a liquid stream without compressing the mixed stream by a compressor, wherein a condensing temperature of the mixed stream including the first overhead vapor is higher than a condensing temperature of the first overhead vapor by mixing the first overhead vapor with one of the divided streams of the condensed liquid in step (e) to lower an operating pressure of the first distillation column;

(g) discharging the whole or a part of the liquid stream obtained from step (f), as the liquid fraction enriched in methane and ethane;

(h) supplying another of the two or more streams obtained by dividing the condensed liquid in step (e) to the second distillation column as reflux liquid; and (i) discharging the second bottom liquid as the liquid fraction enriched in the hydrocarbon having 3 or more carbon atoms.

2. The method according to claim 1, wherein the second overhead vapor is subcooled in step (d).

3. The method according to claim 1, wherein a part of the liquid stream obtained from step (f) is discharged as the liquid fraction enriched in methane and ethane in step (g); and wherein the method comprises:

(j) supplying a remainder of the liquid stream obtained from step (f) to the first distillation column as reflux liquid.

4. The method according to claim 1, comprising:

(k) performing vapor-liquid separation of the vapor-liquid two-phase stream obtained from step (a), supplying a liquid phase obtained from the vapor-liquid separation to the first distillation column in step (b), and mixing a vapor phase obtained from the vapor-liquid separation into the first overhead vapor.

5. The method according to claim 1, wherein a heating medium is cooled using cold heat of fluid inside the first distillation column, and the cooling in step (d) is performed using the cooled heating medium.

6. The method according to claim 1, wherein the cooling in step (d) is performed by giving cold heat of fluid inside the first distillation column directly to the second overhead vapor by heat exchange.

7. The method according to claim 1, wherein the cooling in step (d) is performed using an external refrigerant.

8. The method according to claim 1, comprising:

heating the vapor-liquid two-phase stream obtained from step (a) before step (b) using another heat exchanger which is separate from the heat exchanger used in step (a).

9. The method of claim 1, wherein in step (f), a condensing temperature of the mixed stream including the first overhead vapor is higher than a condensing temperature of the first overhead vapor by mixing the first overhead vapor with the one of the divided streams of the condensed liquid in step (e) to lower an operating pressure of the first distillation column to be lower than 3206 kPaA.

* * * * *